US008209832B1

(12) United States Patent
Anderson et al.

(10) Patent No.: US 8,209,832 B1
(45) Date of Patent: Jul. 3, 2012

(54) TRANSMISSION SEAL INSTALLATION KIT

(76) Inventors: Alvin C. Anderson, Calumet Park, IL (US); Selena A. Anderson, Calumet Park, IL (US)

( * ) Notice: Subject to any disclaimer, the term of this patent is extended or adjusted under 35 U.S.C. 154(b) by 379 days.

(21) Appl. No.: 12/540,631

(22) Filed: Aug. 13, 2009

(51) Int. Cl.
*B25B 27/00* (2006.01)

(52) U.S. Cl. ..... 29/244; 29/255; 29/270

(58) Field of Classification Search ..... 29/244, 29/255, 270, 278, 271, 267
See application file for complete search history.

(56) References Cited

U.S. PATENT DOCUMENTS

| | | | | |
|---|---|---|---|---|
| D249,322 | S | 9/1978 | Diffenderfer | |
| 4,211,446 | A | 7/1980 | Shultz, Sr. | |
| 4,656,715 | A | 4/1987 | Diaz | |
| 4,773,141 | A | 9/1988 | Seredich | |
| 5,174,006 | A * | 12/1992 | Ellis | 29/275 |
| 5,713,119 | A | 2/1998 | Lagatta | |
| 5,893,202 | A | 4/1999 | Graham et al. | |
| 6,634,262 | B2 * | 10/2003 | Malchus | 81/490 |
| 7,496,999 | B2 * | 3/2009 | Robarge | 29/265 |
| 7,698,795 | B2 * | 4/2010 | Brock et al. | 29/274 |
| 2003/0029284 | A1 * | 2/2003 | Malchus | 81/490 |
| 2007/0157764 | A1 | 7/2007 | Williams | |
| 2009/0078093 | A1 * | 3/2009 | Suski et al. | 81/121.1 |

* cited by examiner

*Primary Examiner* — Lee D Wilson
(74) *Attorney, Agent, or Firm* — Kyle Fletcher

(57) ABSTRACT

The transmission seal installation kit includes a forward drum seal driver, reverse drum seal driver, a snap ring removal tool, an axle seal installer, and a handle. The tool kit is used for installing and removing a retaining seal that is fitted inside of the forward drum, reverse drum, and axle seal of a transmission, or for the removal of a coast piston from a direct and coast drum.

10 Claims, 16 Drawing Sheets

TRANSMISSION SEAL INSTALLATION KIT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of seal installation kits, more specifically, a seal installation kit for a transmission.

B. Discussion of the Prior Art

As a preliminary note, it should be stated that there is an ample amount of prior art that deals with transmission seal installation kits. As will be discussed immediately below, no prior art discloses a transmission seal installation kit that includes the types of tool accessories useful in installing new seals in a transmission.

The Diaz patent (U.S. Pat. No. 4,656,715) discloses a tool set designed to facilitate the removal or installation of clutch housing from the transmission case of a vehicle. However, the tool set is not configured for re-installing a seal in the forward drum of a transmission after removing the old seal.

The Lagatta patent (U.S. Pat. No. 5,713,119) discloses a tool for installing the planetary assembly and reverse clutch assembly of an automatic transmission. The tool includes an elongated tubular handle extending along a longitudinal axis having a first end and an opposed second end, and a grip along the first end with a handle extension. However, the tool is not suited for removing or installing a seal in the forward drum of a transmission.

The Shultz, Sr. patent (U.S. Pat. No. 4,211,446) discloses a tool having a handle grip and protective shield for pulling and removing annular or ring-shaped seals from an automobile transmission housing. Unfortunately, the tool is not capable of installing a new seal onto the forward drum of a transmission.

The Williams Patent Application Publication (U.S. Pub. No. 2007/0157764) discloses a universal tool for installation of an annular seal for a front axle, as well as a rear axle of a vehicle, which includes a handle, a customized body member capable of being reversibly attached to the handle for placement and insertion of one of two sizes of seals in the motor vehicle axle housing. However, the universal tool is not suited for use in installing a seal in a forward drum of a transmission.

The Ellis patent (U.S. Pat. No. 5,174,006) discloses an installation tool to install an annular seal or hub or housing at an axle or shaft of a motor vehicle. However, the installation tool is suited for use installing a seal onto an axle or shaft of a motor as opposed to a new seal for a forward drum.

The Graham et al. patent (U.S. Pat. No. 5,893,202) discloses a tool and method by which the inner oil seal may be installed in the hub of a dual tire and wheel assembly (or a single tire and wheel assembly) while it remains in a normal, upright position. However, the tool is not suited for use in installing a seal in the forward drum of a transmission, but rather a tire and wheel assembly.

The Seredich patent (U.S. Pat. No. 4,773,141) discloses a press for seating a joint seal and metal retainer ring on a constant velocity axle. However, the press is for use with a joint seal for an axle that is constantly rotating as opposed to a seal for a forward drum of a transmission.

While the above-described devices fulfill their respective and particular objects and requirements, they do not describe a transmission seal installation kit that is useful in installing new seals in a transmission. In this regard, the transmission seal installation kit departs from the conventional concepts and designs of the prior art.

SUMMARY OF THE INVENTION

The transmission seal installation kit includes a forward drum seal driver, reverse drum seal driver, a snap ring removal tool, an axle seal installer, and a handle. The tool kit is used for installing and removing a retaining seal that is fitted inside of the forward drum, reverse drum, and axle seal of a transmission, or for the removal of a coast piston from a direct and coast drum.

It is an object of the invention to provide a tool kit for the installation of a retaining seal in a forward drum, reverse drum, or axle seal of a transmission.

It is a further object of the invention to provide a series of seal drivers that are designed to install new seals to various transmission drums without damaging the seal during installation.

It is a further object of the invention to provide a snap ring removal tool for use with snap ring pliers when removing a coast piston from a direct and coast drum assembly.

These together with additional objects, features and advantages of the provide a transmission seal installation kit will be readily apparent to those of ordinary skill in the art upon reading the following detailed description of presently preferred, but nonetheless illustrative, embodiments of the provide a transmission seal installation kit when taken in conjunction with the accompanying drawings.

In this respect, before explaining the current embodiments of the transmission seal installation kit in detail, it is to be understood that the transmission seal installation kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the transmission seal installation kit. It is therefore important that the claims be regarded as including such equivalent construction insofar as they do not depart from the spirit and scope of the transmission seal installation kit. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
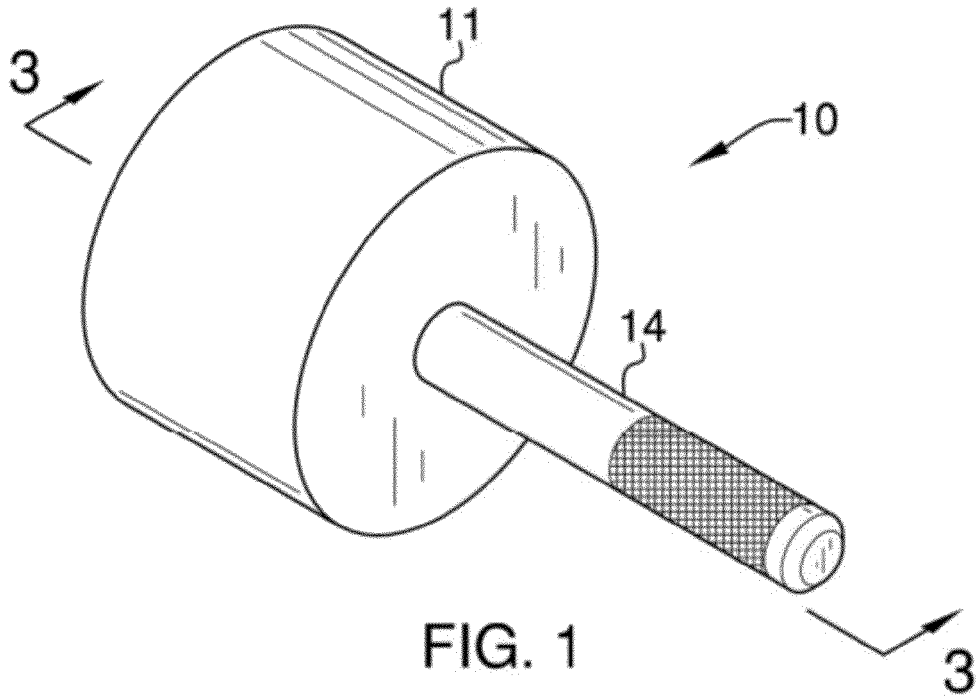
FIG. 1 illustrates an isometric view of the reverse drum driver and the handle.
Figure 2:
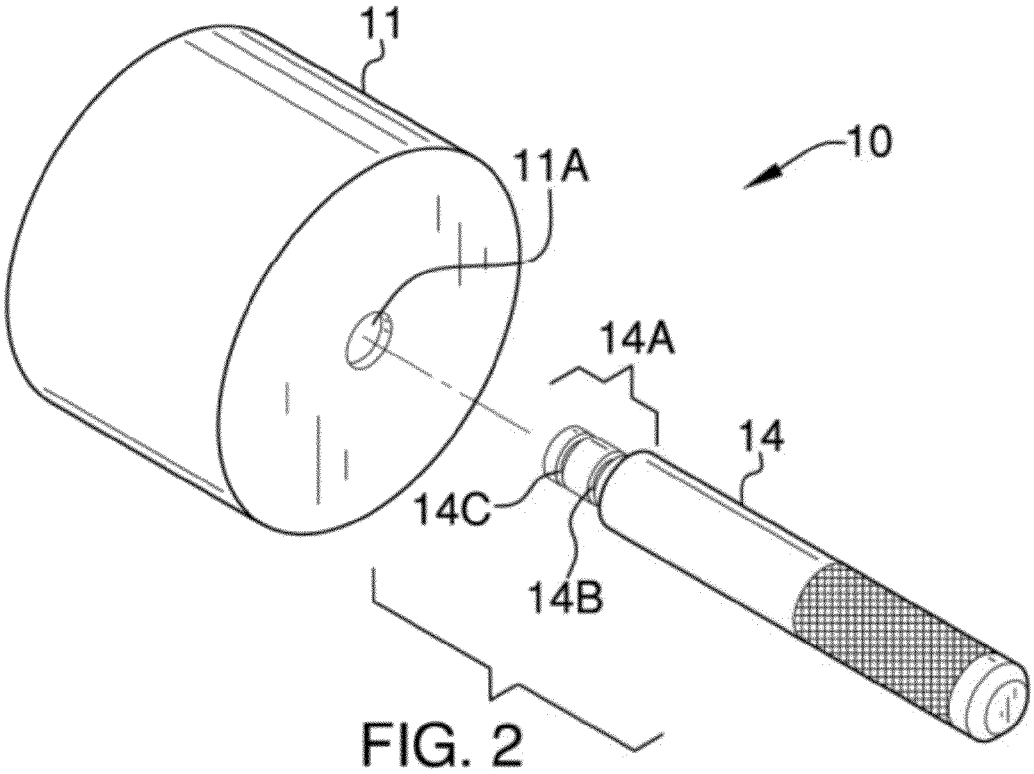
FIG. 2 illustrates an exploded view of the reverse drum driver and handle.

Detailed reference will now be made to the preferred embodiment of the present invention, examples of which are illustrated in FIGS. 1-8A. A transmission seal installation kit 10 (hereinafter invention) includes a reverse drum seal driver 11, a forward drum seal driver 12, a snap ring removal tool 13, a handle 14, and an axle seal installer 16.

It shall be noted from the outset that the invention 10 is most suitably used with the installation of new seals in a 4T40 transmission. However, it shall be further noted that the invention 10 may be adopted for use with other transmissions.

Figure 3:
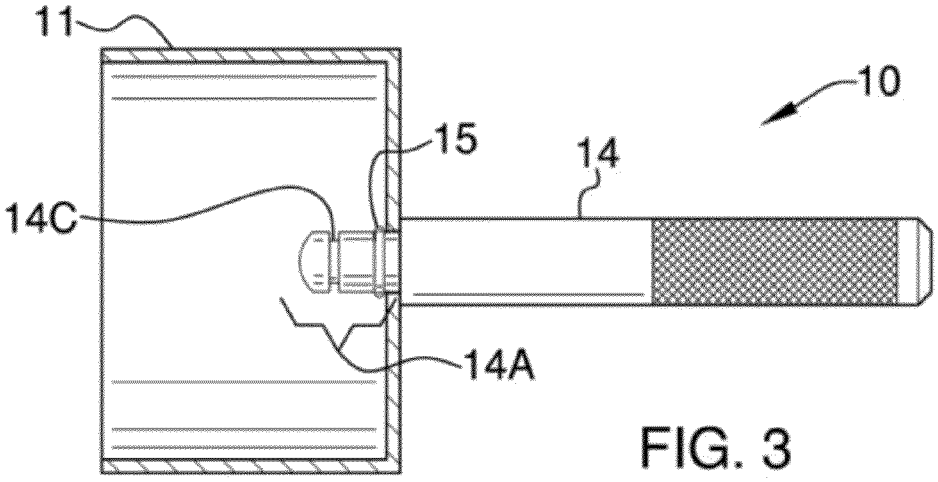
FIG. 3 illustrates a cross-sectional view of the assembly along line 3-3 in FIG. 1.
Figure 4:
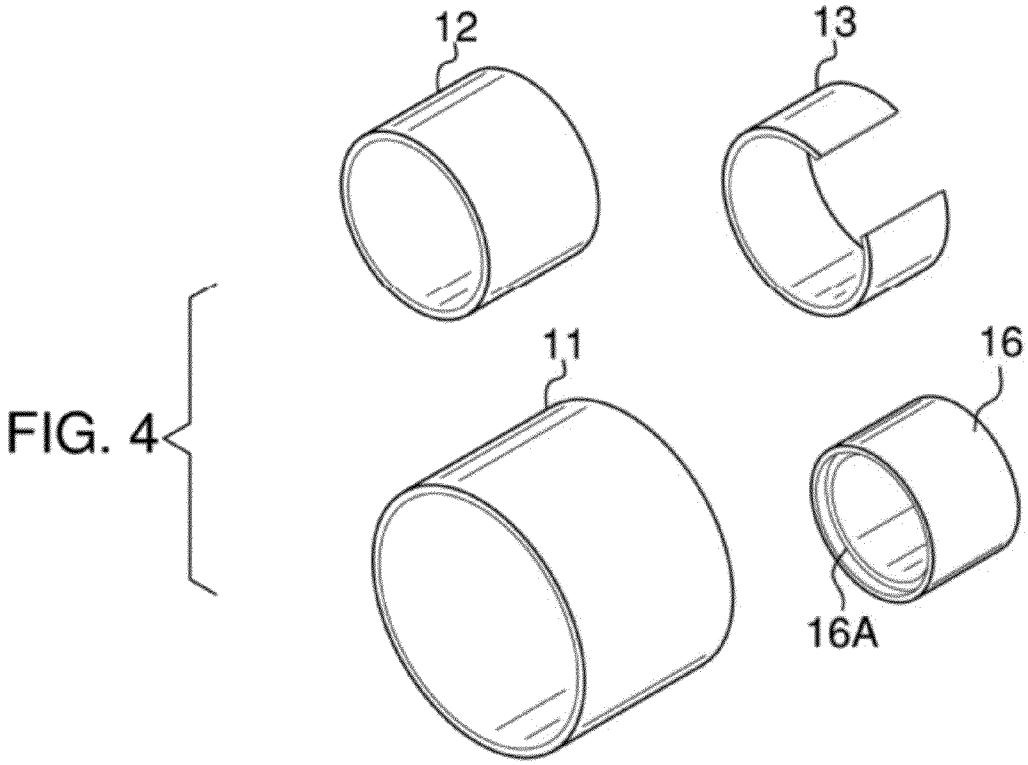
FIG. 4 illustrates the reverse drum driver, forward drum seal driver, snap ring removal tool, and axle seal installer.

The reverse drum seal driver 11 has a small opening 11A. The handle 14 has a shoulder 14A containing both an inner grooved notch 14B and an outer grooved notch 14C. The inner grooved notch 14B has an O-ring 15 situated such that the handle 14 is snuggly fitted to the reverse drum seal driver 11, as depicted in FIG. 3. The forward drum seal driver 12 has a small opening 12A, and attaches to the handle 14 in the same way as the reverse drum seal driver 11.

Figure 5:
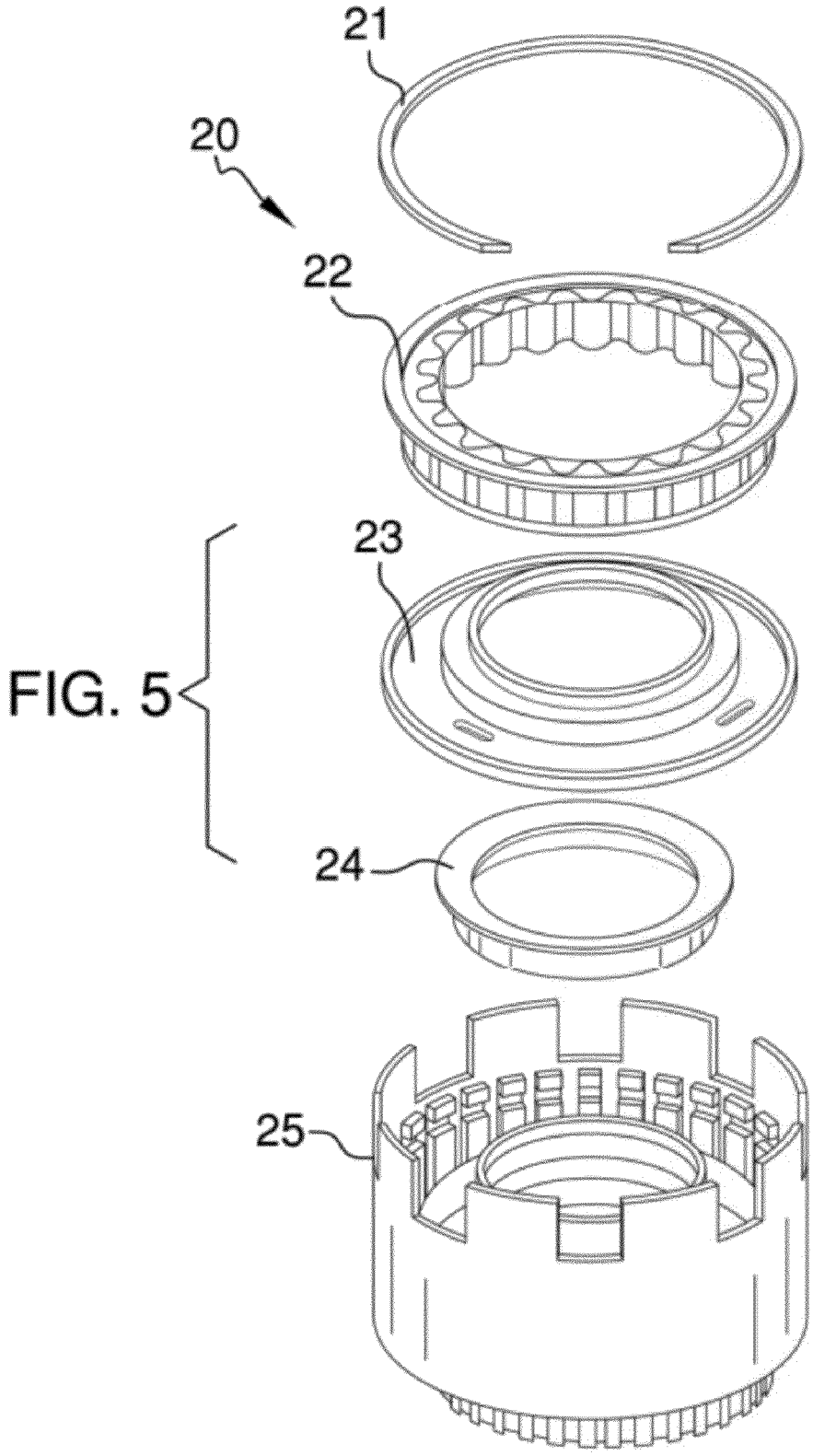
FIG. 5 illustrates an exploded view of a reverse drum assembly detailing the snap ring, spring & retainer, reverse piston, inner seal, and reverse drum.
Figure 5A:
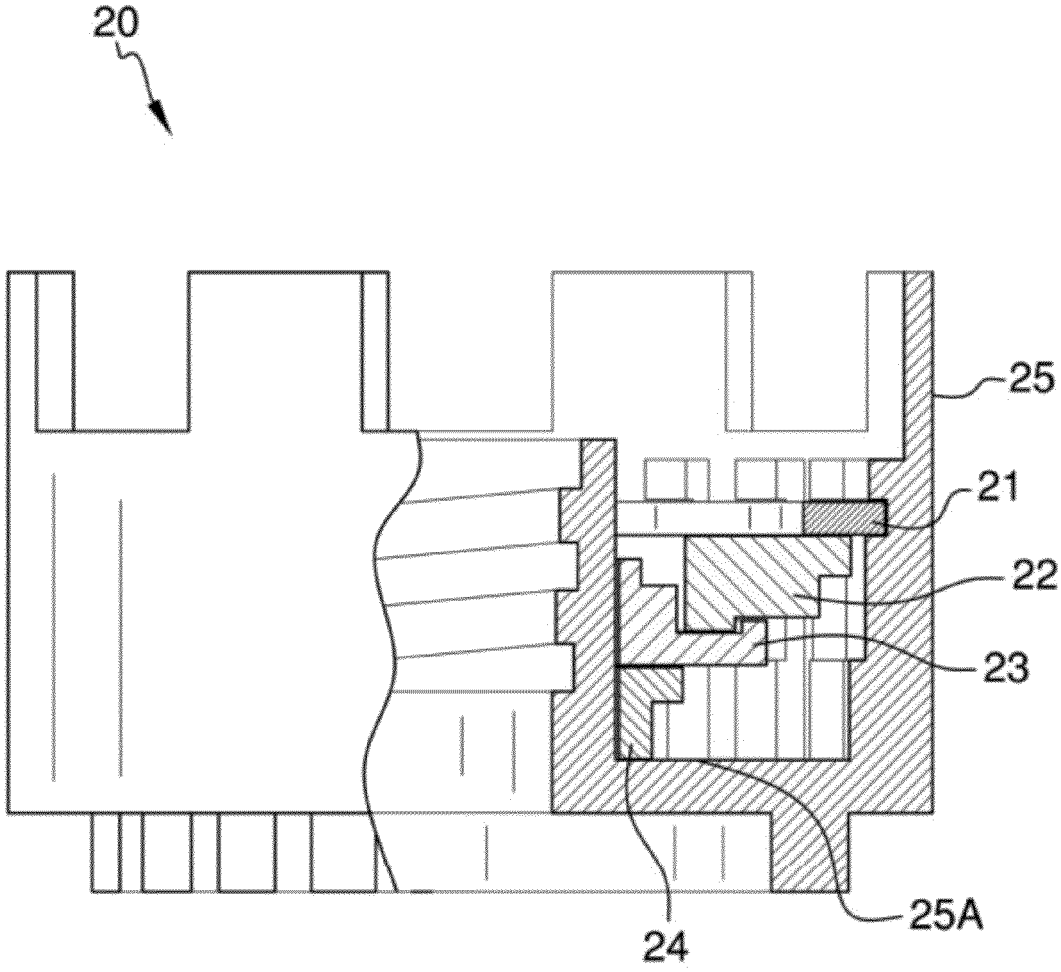
FIG. 5A illustrates a cut-away view of the reverse drum and detailing the inter-relation of the inner seal, reverse piston, spring & retainer, snap ring, and reverse drum.
Figure 5B:
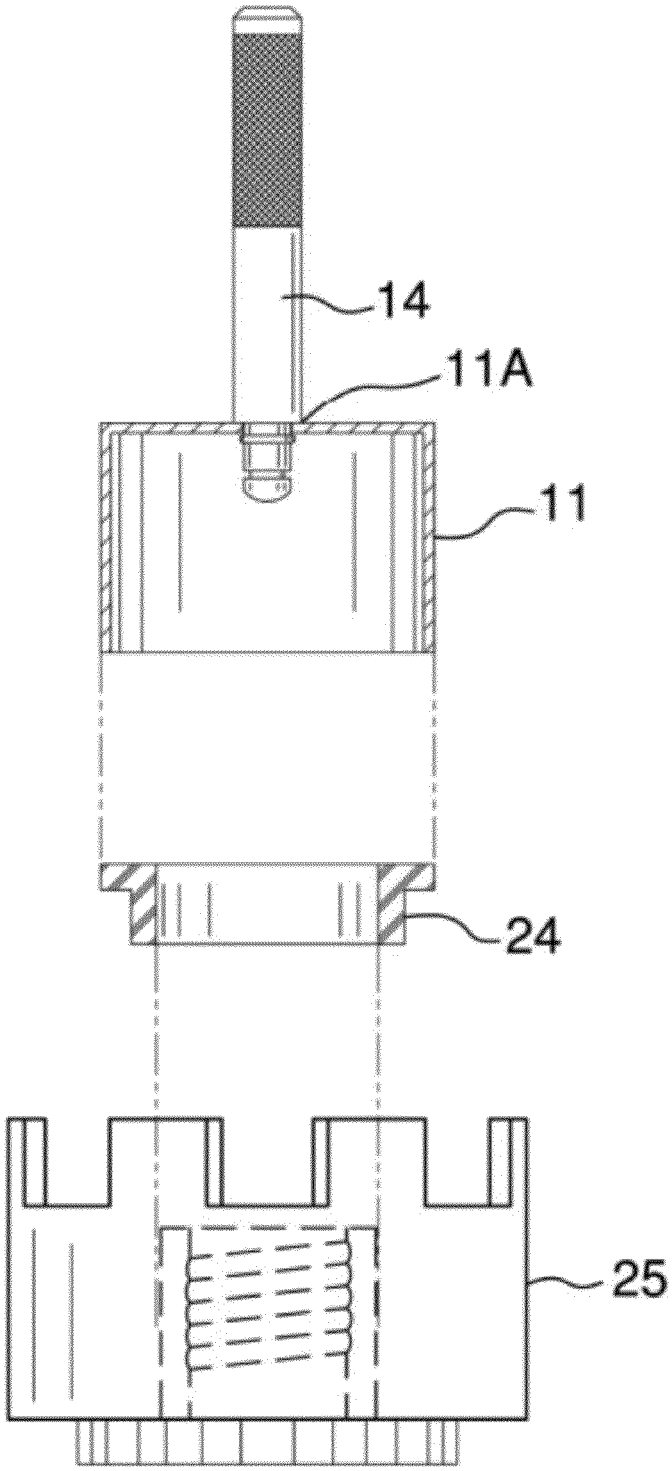
FIG. 5B illustrates a cross-sectional view of the reverse drum seal driver and snap ring tool connected to the handle and aligned above for installation of a new reverse drum seal into the reverse drum.

Referring to FIGS. 5-5B, a reverse drum assembly 20 is composed of a snap ring 21, a spring & retainer 22, a reverse piston 23, an inner seal 24, and the reverse drum housing 25. The invention 10 is used with the installation of a new inner seal 24 with the reverse drum assembly 20. FIG. 5A depicts the reverse drum assembly 20 installed inside of the reverse drum housing 25. When the time comes to replace the inner seal 24, an end user would remove in order: (1) the snap ring 21, (2) the spring & retainer 22, (3) the reverse piston 23, and (4) the inner seal 24. Next, an end user would place a new inner seal 24 onto the reverse drum housing 25, and then push via the invention 10, the inner seal 24 down until it is seated against a bottom surface 25A of the reverse drum housing 25.

Figure 6:
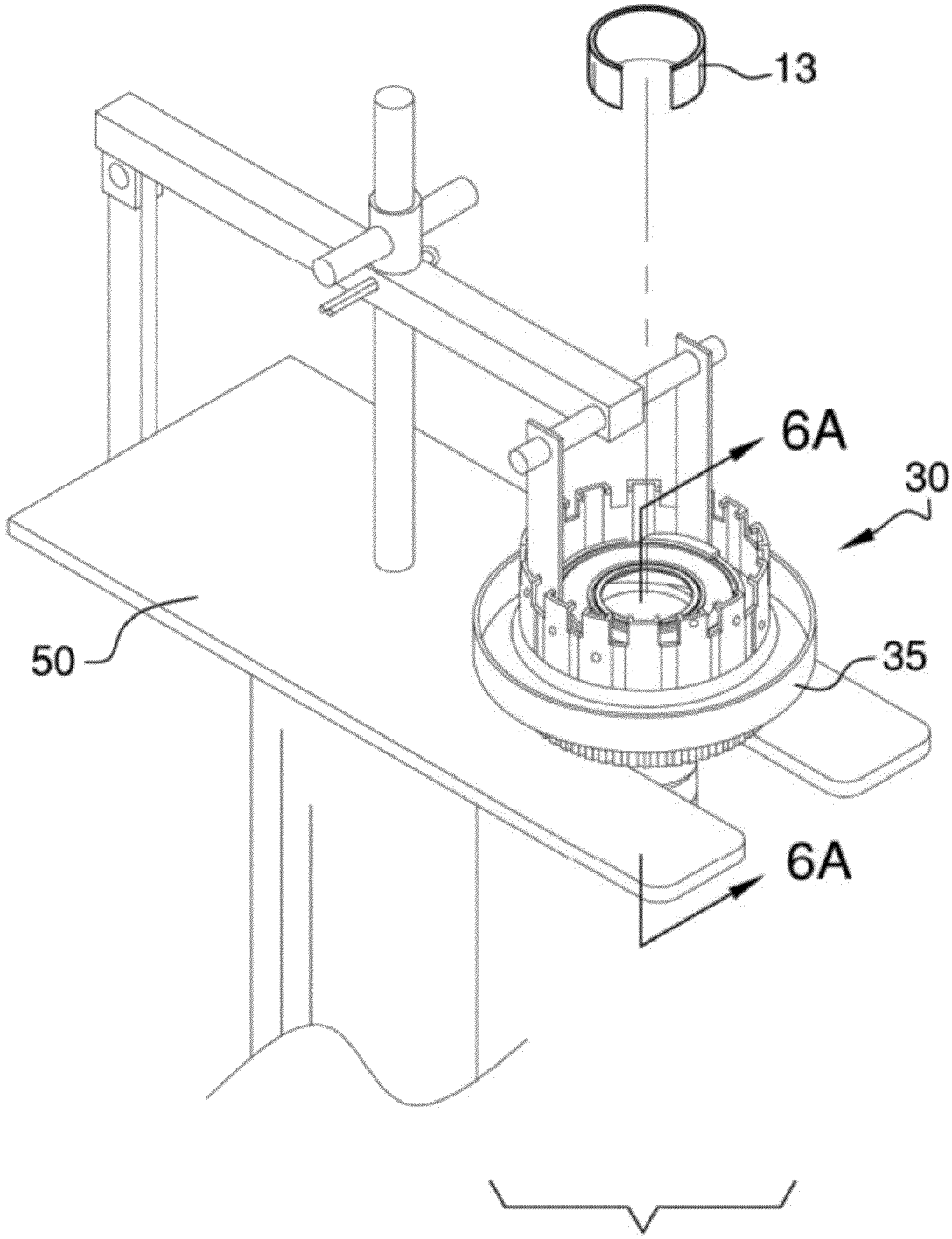
FIG. 6 illustrates placement of the snap ring tool into the direct and coast drum located on a foot press.
Figure 6A:
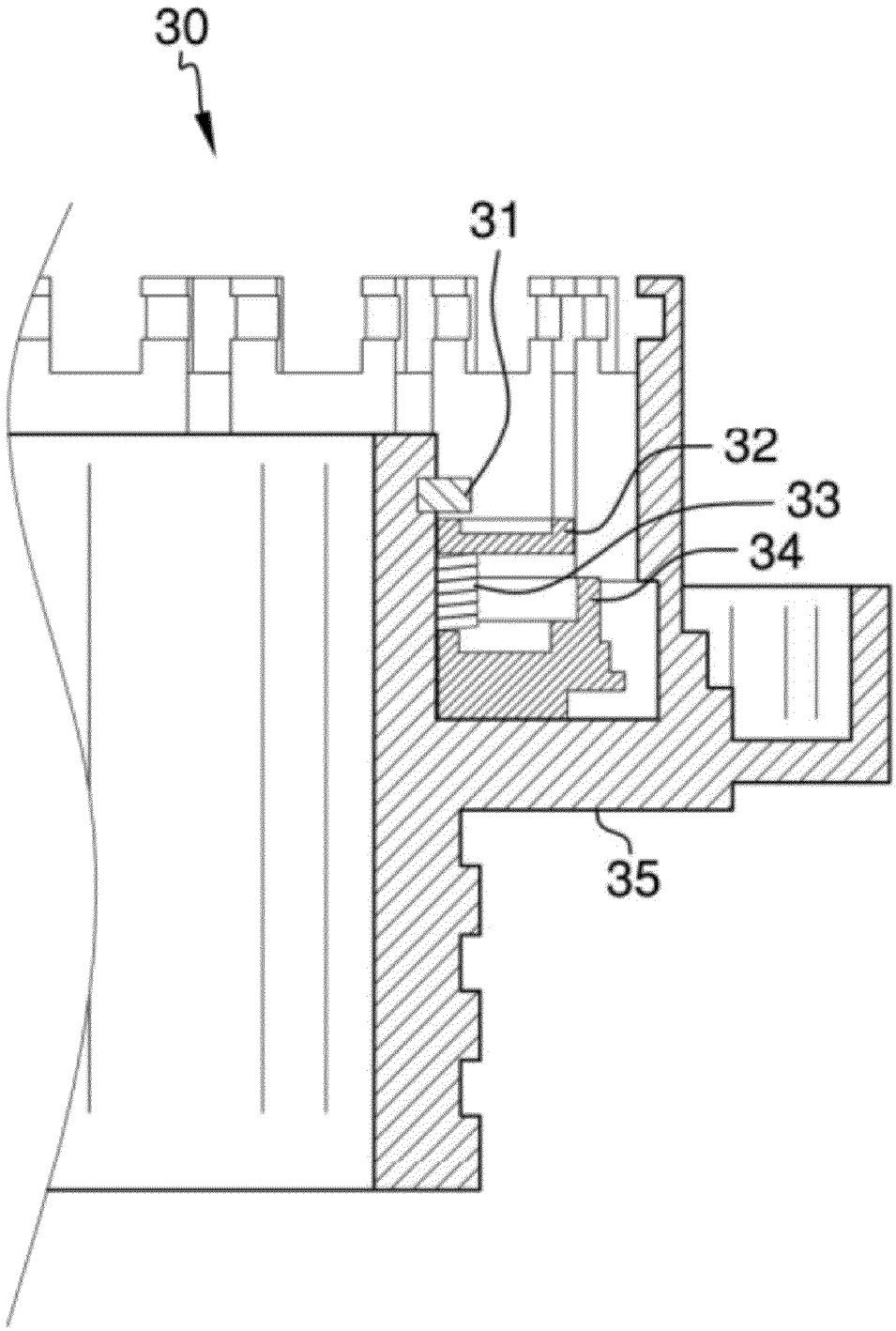
FIG. 6A illustrates a cut-away view of the direct and coast drum and detailing the inter-relation of the coast piston, spring, retainer, snap ring, and direct and coast drum.
Figure 6B:
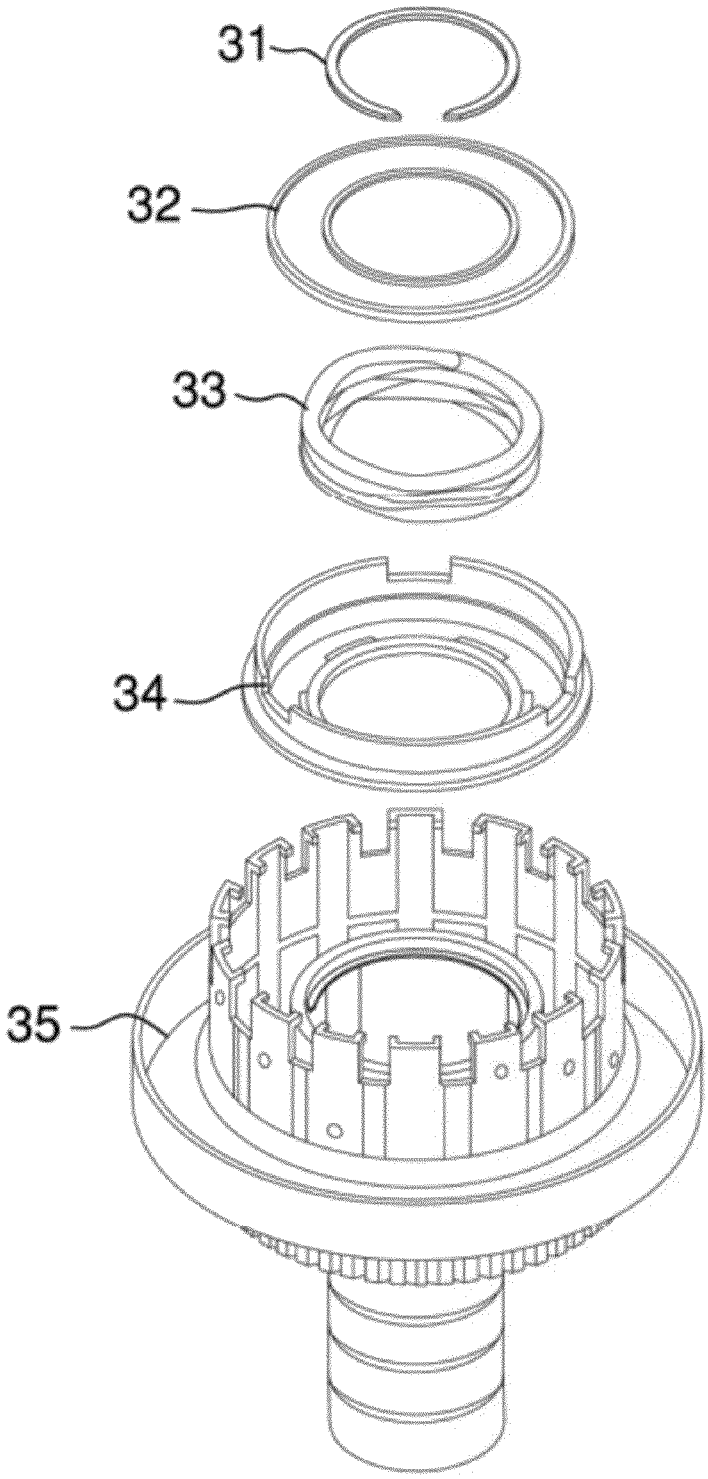
FIG. 6B illustrates an exploded view of a direct and coast drum assembly detailing the snap ring, retainer, spring, coast piston, direct and coast drum.
Figure 6C:
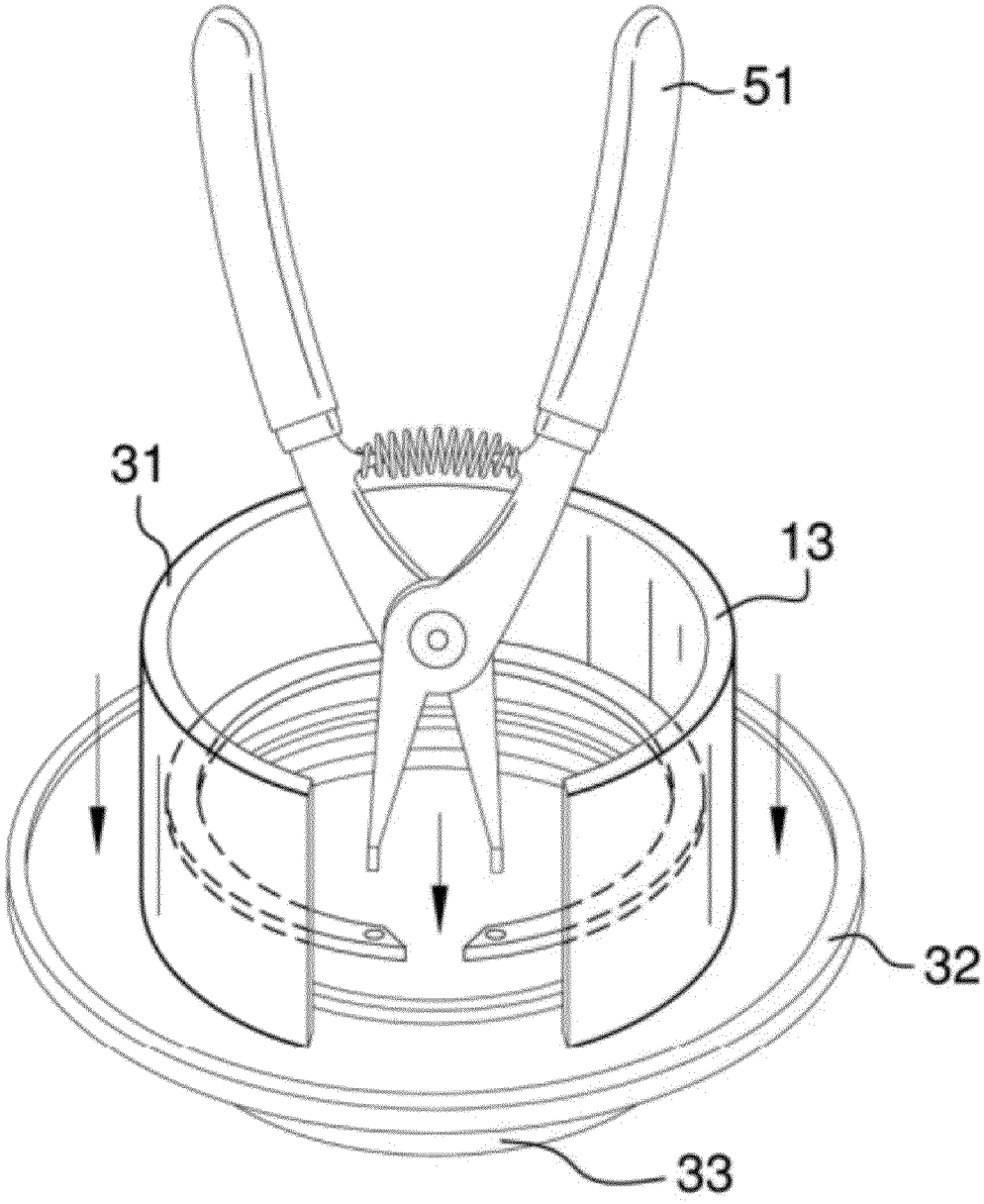
FIG. 6C illustrates an isometric view of a pair of pliers removing the snap ring from the direct and coast drum along with downward movement of the snap ring removal tool in order to maintain the retainer above the spring.
Figure 6D:
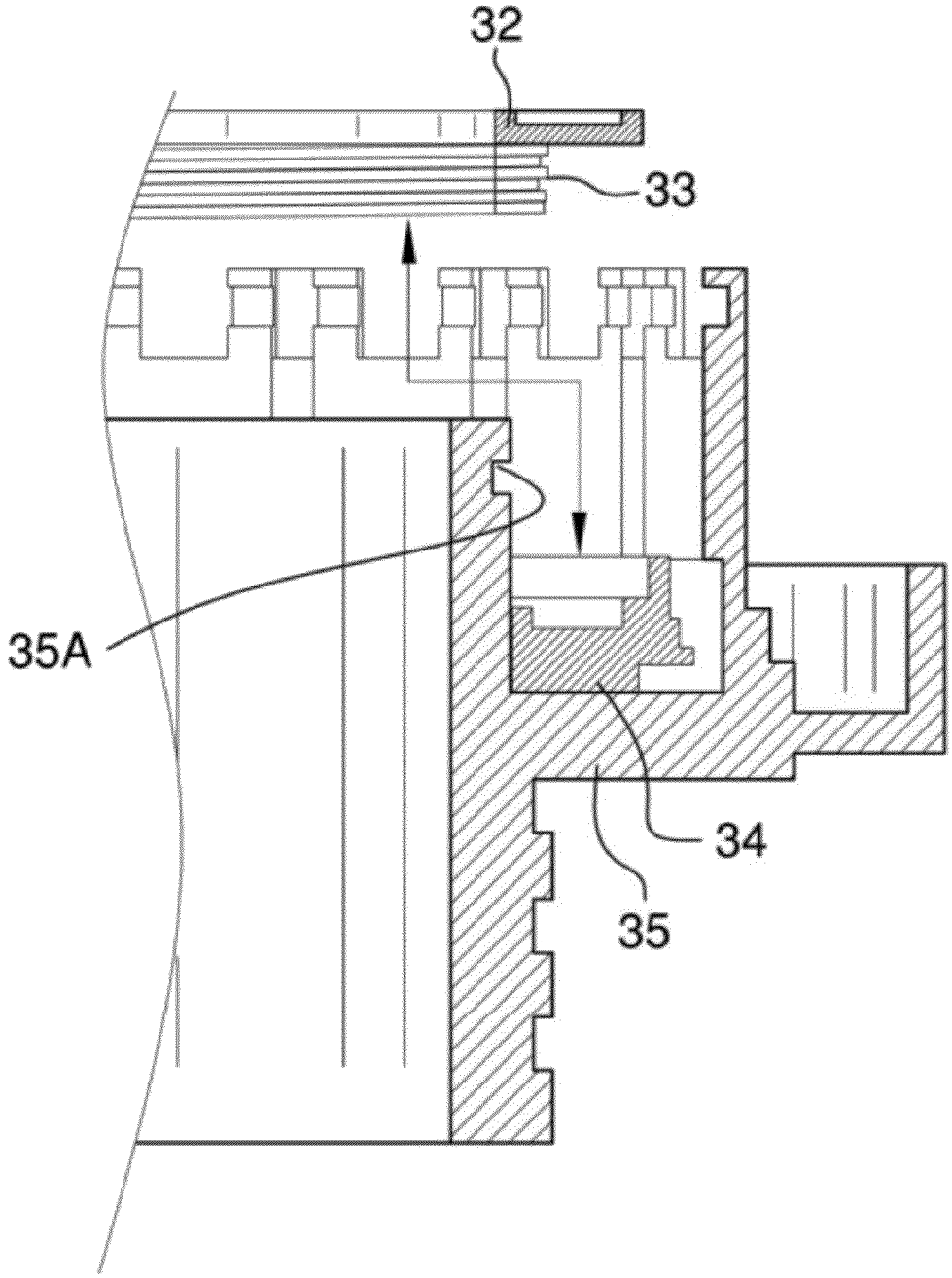
FIG. 6D illustrates removal of the retainer and spring from the direct and coast drum.

Referring to FIGS. 6-6D, a direct and coast drum assembly 30 is composed of a snap ring 31, a retainer 32, a spring 33, coast piston 34, and a direct and coast housing 35. The invention 10 is used with the removal of the snap ring 31 prior to replacement of the coast piston 34. Absent the invention 10, upon removal of the snap ring 31 would result in the separation of the spring 33 and retainer 32. A foot press 50 and the snap ring removal tool 13 are used to stabilize the spring 33 during removal of the snap ring 31 via snap ring pliers 51, see FIGS. 6 and 6C.

Figure 7:
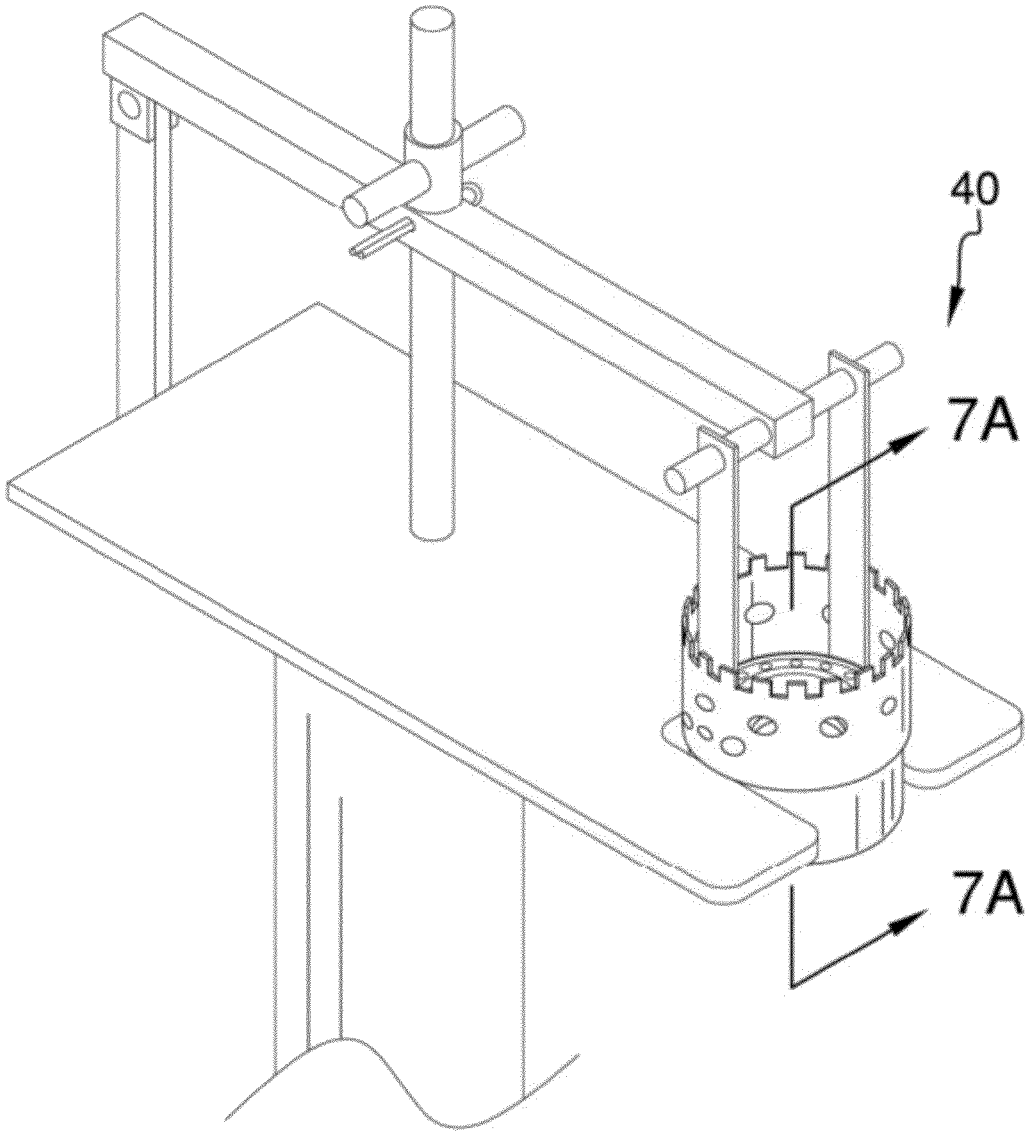
FIG. 7 illustrates placement of the forward drum in a foot press.
Figure 7A:
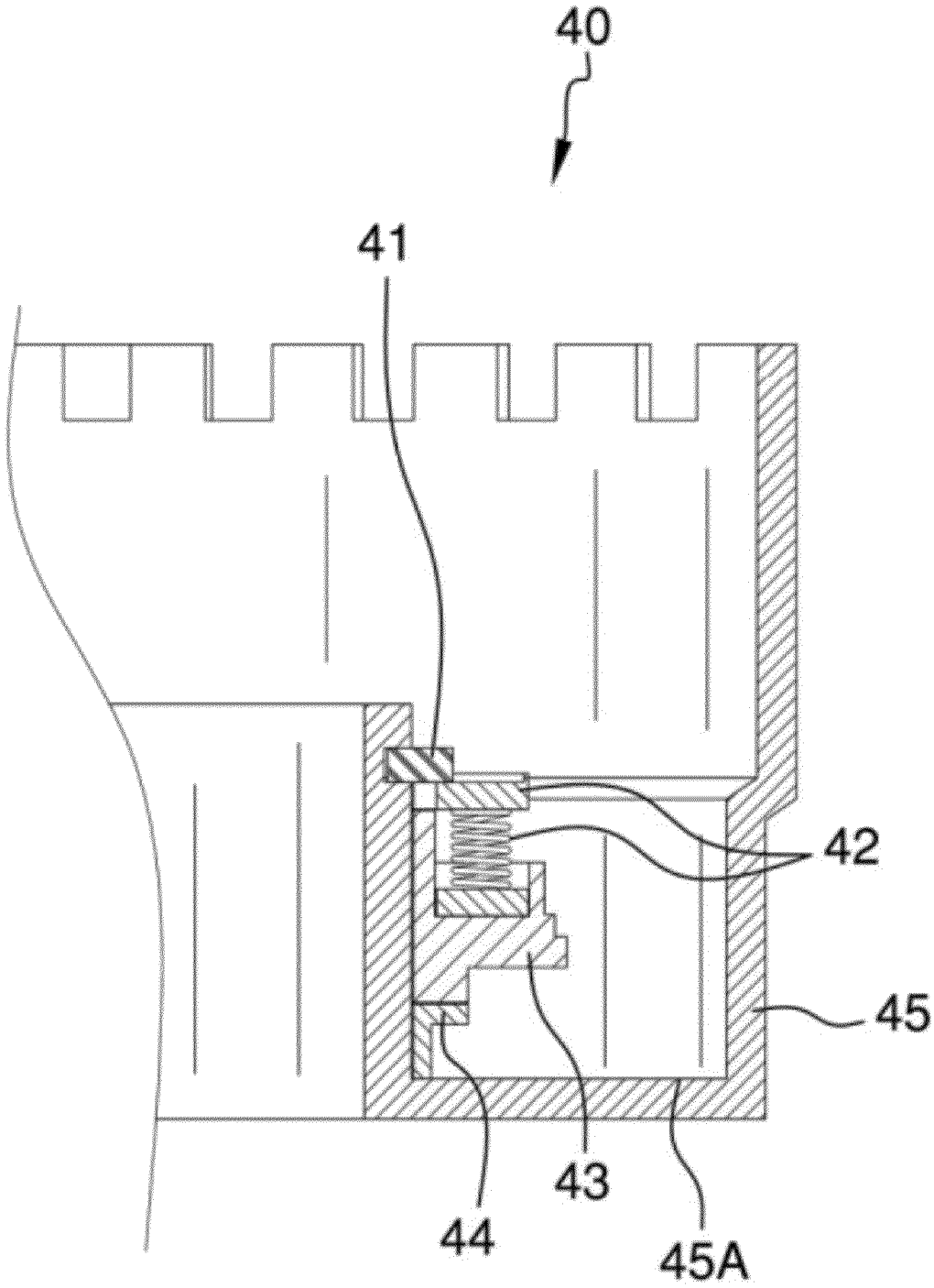
FIG. 7A illustrates a cut-away view of the forward drum detailing the inter-relation of the snap ring, retainer, spring, forward piston, and inner seal.
Figure 7B:
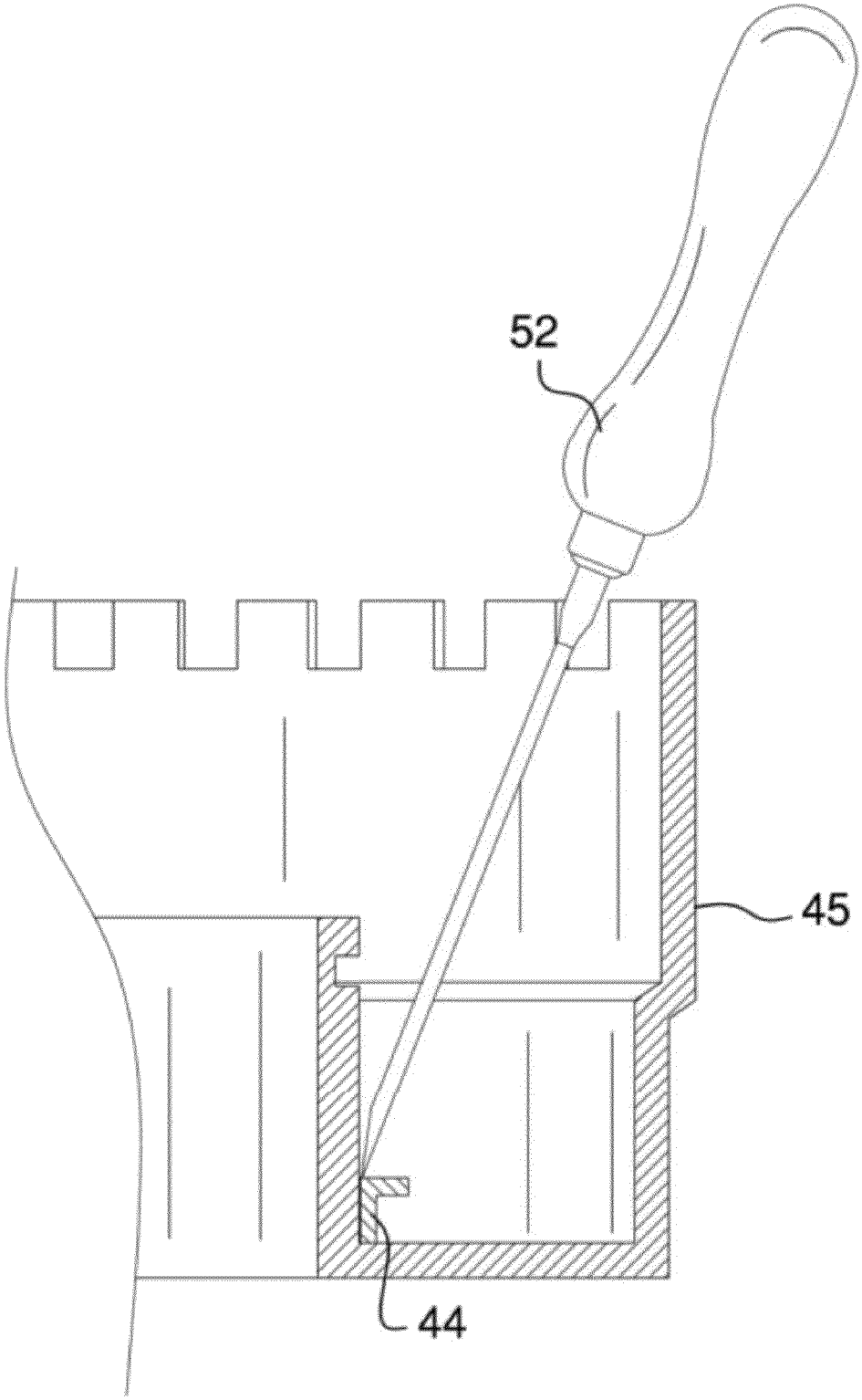
FIG. 7B illustrates a chisel removing a spent inner seal from the forward seal.
Figure 7C:
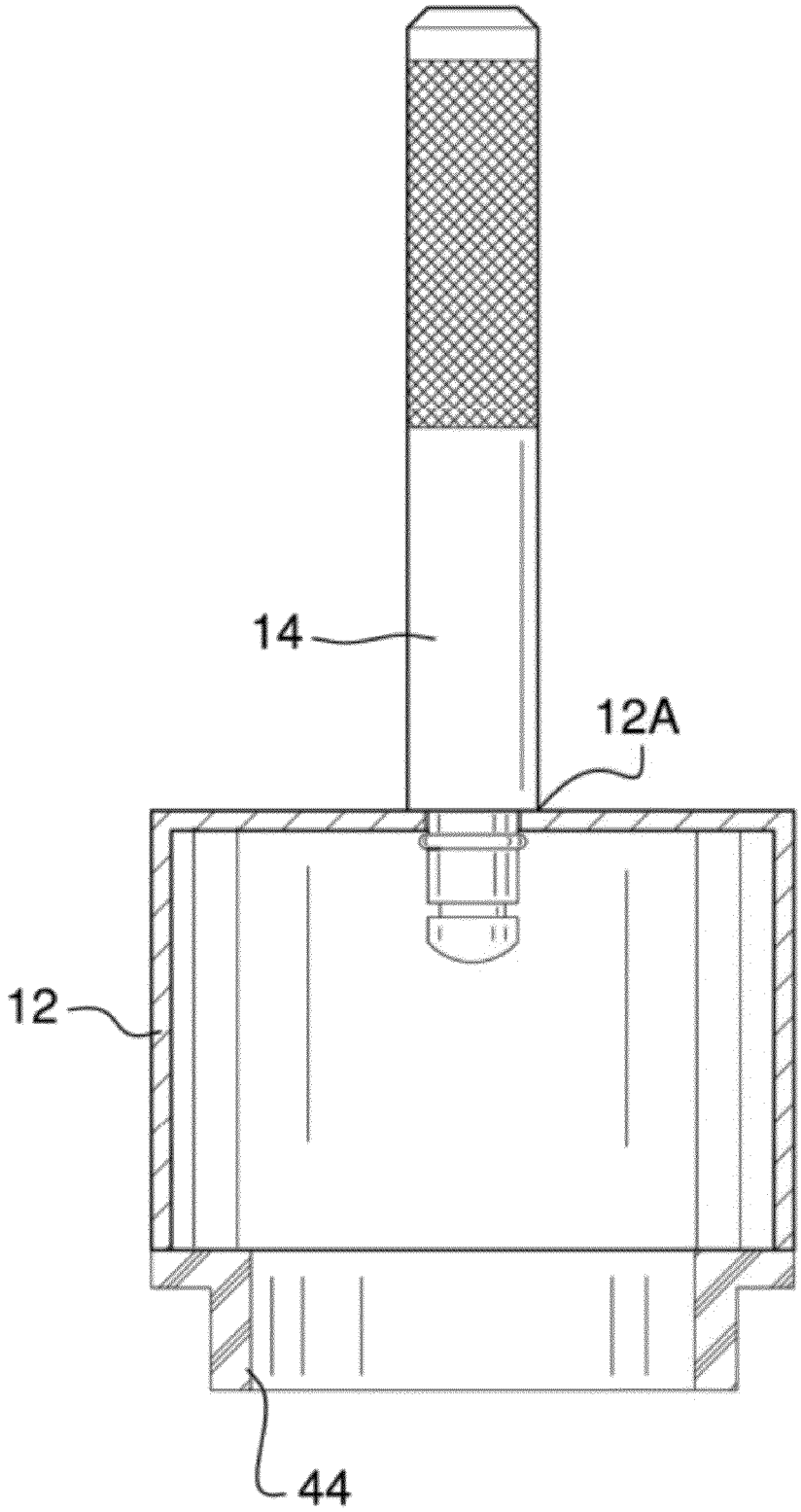
FIG. 7C illustrates a forward drum seal driver and tool insert attached upon a handle as well as a new inner seal.

Referring to FIGS. 7-7C, a forward drum assembly 40 is composed of a snap ring 41, a spring & retainer 42, a forward piston 43, an inner seal 44, and a forward drum 45. The invention 10 is used to install a new inner seal 44 with the forward drum seal driver 12 in a manner analogous to that of the reverse drum seal driver 11 mentioned above. FIG. 7A depicts the forward drum assembly 40 installed inside of the forward drum housing 45. When the time comes to replace the inner seal 44, an end user would remove in order: (1) the snap ring 41, (2) the spring & retainer 42, (3) the forward piston 43, and (4) the inner seal 44 (see FIG. 7B detailing the use of a hand tool 52 to remove the inner seal 44 from the forward drum housing 45). Next, an end user would place a new inner seal 44 onto the forward drum housing 45, and then push via the invention 10, the inner seal 44 down until it is seated against a bottom surface 45A of the forward drum housing 45.

Figure 8:
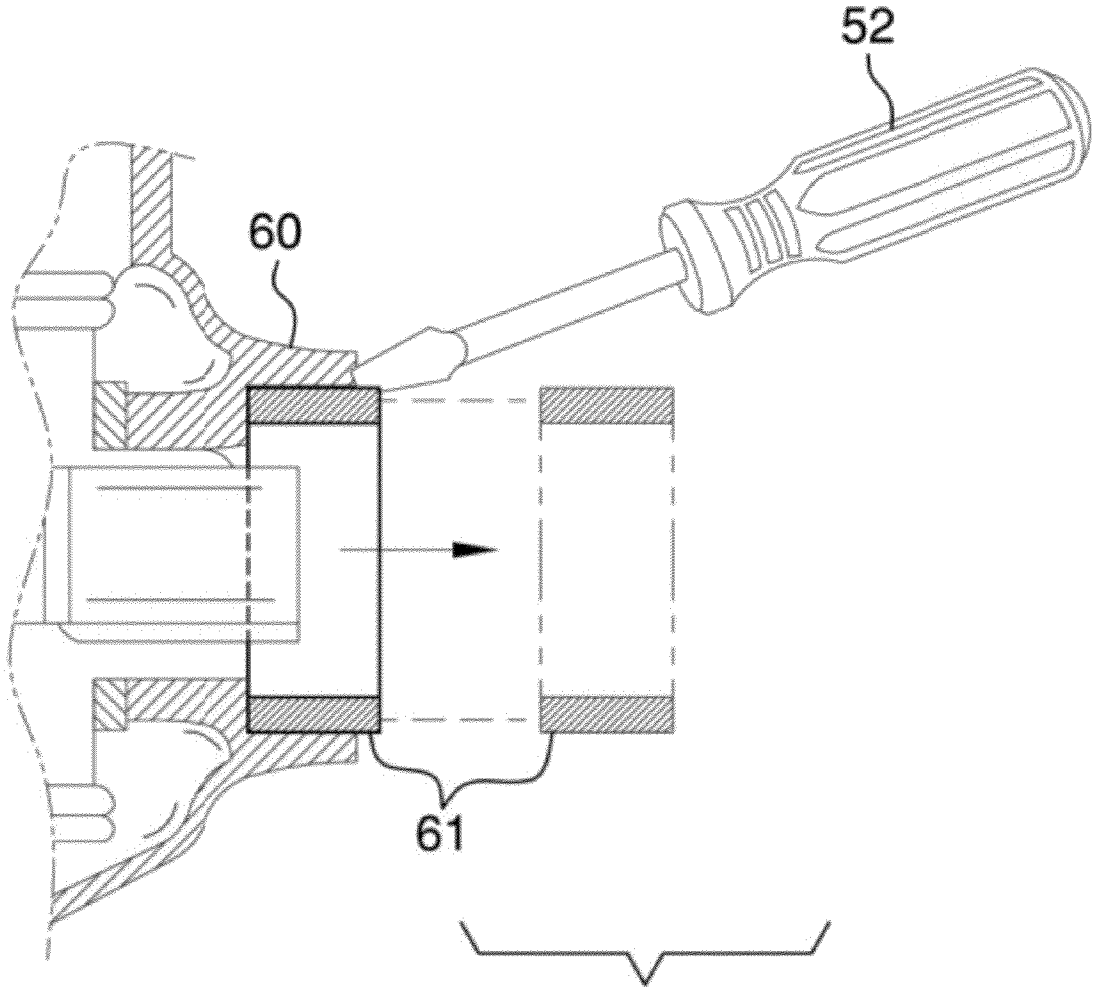
FIG. 8 illustrates a screwdriver removing a spent axle seal from the transmission case.
Figure 8A:
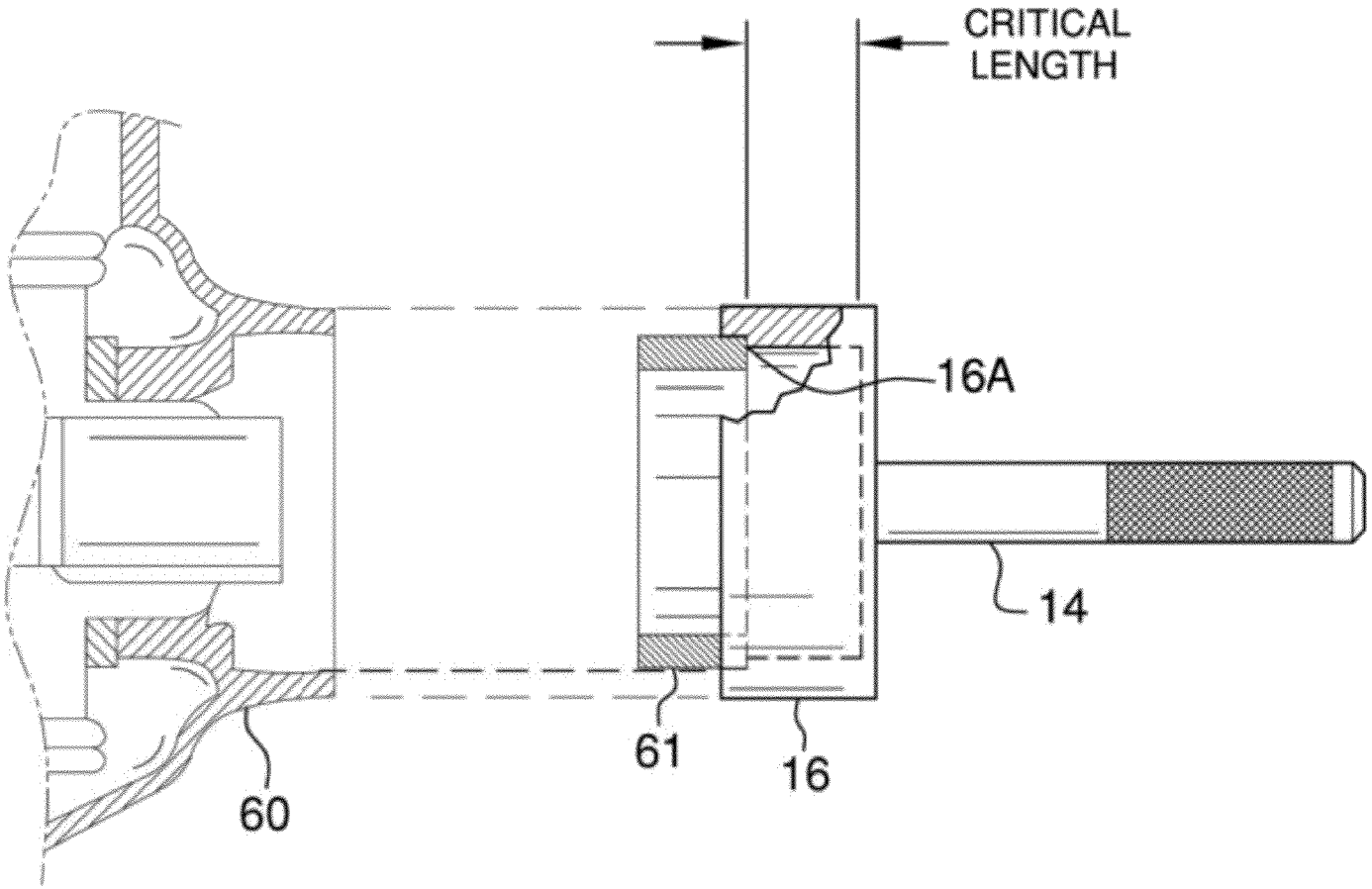
FIG. 8A illustrates the axle seal driver installed upon the handle and aligned adjacent the transmission case.

Referring to FIGS. 8-8A, a transmission case 60 has an axle seal 61 that extends slightly from the transmission case 60. Removal of the axle seal 61 is accomplished via a hand tool 52. Installation of a new axle seal is achieved via the axle seal installer 16. The axle seal installer 16 has a shoulder 16A that has a distance equal to that of the slight extension of the axle seal 61 from the transmission case 60, mentioned above. The axle seal installer 16 insures that the axle seal 61 is installed at the proper distance with respect to the outer surface of the transmission case 60.

All told, the invention 10 is useful in removing or installing various components of a transmission via a handle 14 and corresponding drivers. The utility of the invention 10 is in the ease of driving seals to the appropriate positions without damage to the seal or surrounding assemblies.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A transmission seal installation kit comprising:

a plurality of seal drivers;

wherein each of the seal drivers has a specific design suitable for driving a seal to the proper location of a particular transmission drum;

wherein said particular transmission drum is a 4T40 transmission;

a handle;

wherein the handle attaches to each seal driver, and is removable in order to change seal drivers for specific uses;

wherein the plurality of seal drivers are further defined as a forward drum seal driver and a reverse drum seal driver;

wherein the reverse drum seal driver and the forward drum seal driver each have a small opening;

wherein the handle has a shoulder containing both an inner grooved notch and an outer grooved notch;

wherein the inner grooved notch has an O-ring situated such that the handle is snuggly fitted to either the reverse drum seal driver or the forward drum seal driver;

wherein a snap ring removal tool is provided to be used in conjunction with a foot press in order to remove a snap ring from a direct and coast drum, a reverse drum assembly, or a forward drum assembly of said 4T40 transmission;

the reverse drum seal driver is used in connection with the reverse drum assembly in order to replace an inner seal and requires removal of a snap ring, a spring and retainer, a reverse piston, and said inner seal;

wherein a new inner seal is placed onto a reverse drum housing, and then pushed via the reverse drum seal driver until the new inner seal is seated against a bottom surface of the reverse drum housing;

wherein the forward drum seal driver is used in connection with the forward drum assembly in order to replace an inner seal located therein and requires removal of a snap ring, a spring and retainer, a forward piston, and said inner seal;

wherein a new inner seal is placed onto a forward drum housing, and then pushed via the forward drum seal driver until the new inner seal is seated against a bottom surface of the forward drum housing;

wherein an axle seal installer is included with said kit, and is used to install a new axle seal onto a transmission case;

wherein the axle seal installer has a shoulder that has a distance equal to that of a slight extension of the axle seal from a transmission case such that the axle seal installer pushes the new axle seal onto said transmission case at a proper distance with respect to an outer surface of said transmission case.

2. The transmission seal installation kit as described in claim 1 wherein the seal drivers and the handle are made of a material comprising a metal, plastic, or wood.

3. A transmission seal installation kit wherein a handle has a plurality of attachable seal drivers that are directed to the installation of new seals for a forward drum seal, a reverse drum seal, and an axle drum seal of a transmission; and wherein the seal drivers are capable of driving the respective seal to the desired location without damaging the seal being installed;

wherein a snap ring removal tool is provided to be used in conjunction with a foot press in order to remove a snap ring from a direct and coast drum of a transmission.

4. The transmission seal installation kit as described in claim 3 wherein the seal drivers and the handle are made of a material comprising a metal, plastic, or wood.

5. The transmission seal installation kit described in claim 3 wherein the plurality of attachable seal drivers are further defined as a forward drum seal driver and a reverse drum seal driver; wherein the reverse drum seal driver and the forward drum seal driver each have a small opening; wherein the handle has a shoulder containing both an inner grooved notch and an outer grooved notch; wherein the inner grooved notch has an O-ring situated such that the handle is snuggly fitted to either the reverse drum seal driver or the forward drum seal driver; wherein a snap ring removal tool is provided to be used in conjunction with a foot press in order to remove a snap ring from a direct and coast drum, a reverse drum assembly, or a forward drum assembly of said 4T40 transmission; the reverse drum seal driver is used in connection with the reverse drum assembly in order to replace an inner seal and requires removal of a snap ring, a spring and retainer, a reverse piston, and said inner seal; wherein a new inner seal is placed onto a reverse drum housing, and then pushed via the reverse drum seal driver until the new inner seal is seated against a bottom surface of the reverse drum housing; wherein the forward drum seal driver is used in connection with the forward drum assembly in order to replace an inner seal located therein and requires removal of a snap ring, a spring and retainer, a forward piston, and said inner seal; wherein a new inner seal is placed onto a forward drum housing, and then pushed via the forward drum seal driver until the new inner seal is seated against a bottom surface of the forward drum housing; wherein an axle seal installer is included with said kit, and is used to install a new axle seal onto a transmission case; wherein the axle seal installer has a shoulder that has a distance equal to that of a slight extension of the axle seal from a transmission case such that the axle seal installer pushes the new axle seal onto said transmission case at a proper distance with respect to an outer surface of said transmission case.

6. A transmission seal installation kit comprising of a handle, forward drum seal driver, reverse drum seal driver, and axle seal installer, which are directed to the installation of new seals for a forward drum seal, a reverse drum seal, and an axle drum seal of a 4T40 transmission; and wherein the seal drivers are capable of driving the respective seal to the desired location without damaging the seal being installed;

wherein a snap ring removal tool is provided to be used in conjunction with a foot press in order to remove a snap ring from a direct and coast drum of a transmission;

wherein the plurality of seal drivers are further defined as a forward drum seal driver and a reverse drum seal driver;

wherein the reverse drum seal driver and the forward drum seal driver each have a small opening;

wherein the handle has a shoulder containing both an inner grooved notch and an outer grooved notch;

wherein the inner grooved notch has an O-ring situated such that the handle is snuggly fitted to either the reverse drum seal driver or the forward drum seal driver.

7. The transmission seal installation kit as described in claim 6 wherein the forward drum seal driver, reverse drum seal driver, axle seal installer, and the handle are made of a material comprising a metal, plastic, or wood.

8. The transmission seal installation kit as described in claim 6 wherein the reverse drum seal driver is used in connection with a reverse drum assembly in order to replace an inner seal and requires removal of a snap ring, a spring and retainer, a reverse piston, and said inner seal;

wherein a new inner seal is placed onto a reverse drum housing, and then pushed via the reverse drum seal driver until the new inner seal is seated against a bottom surface of the reverse drum housing.

9. The transmission seal installation kit as described in claim 8 wherein the forward drum seal driver is used in connection with a forward drum assembly in order to replace an inner seal located therein and requires removal of a snap ring, a spring and retainer, a forward piston, and said inner seal;

wherein a new inner seal is placed onto a forward drum housing, and then pushed via the forward drum seal driver until the new inner seal is seated against a bottom surface of the forward drum housing.

10. The transmission seal installation kit as described in claim 9 wherein an axle seal installer is included with said kit, and is used to install a new axle seal onto a transmission case;

wherein the axle seal installer has a shoulder that has a distance equal to that of a slight extension of the axle seal from a transmission case such that the axle seal installer pushes the new axle seal onto said transmission case at a proper distance with respect to an outer surface of said transmission case.

* * * * *